US005177459A

United States Patent [19]

Meister

[11] Patent Number: 5,177,459

[45] Date of Patent: Jan. 5, 1993

[54] MODULAR, ELECTRICAL RELAY, AND A COIL AND PLUNGER ASSEMBLY AND A CONTACT AND TERMINAL BASE ASSEMBLY THEREFOR

[76] Inventor: Jack B. Meister, 68 Chimney Ridge Dr., Convent Station, N.J. 07961

[21] Appl. No.: 690,785

[22] Filed: Apr. 24, 1991

[51] Int. Cl.[5] ..... H01H 51/22

[52] U.S. Cl. ..... 335/83; 335/78; 335/128

[58] Field of Search ..... 335/78-86, 335/124, 128, 131, 133, 136; 200/237, 238, 243, 245, 246, 275, 276

[56] References Cited

U.S. PATENT DOCUMENTS 3,470,504 9/1969 Mallory et al. ..... 335/78

4,926,150 5/1990 Buchschmid et al. ..... 335/196

*Primary Examiner*—Lincoln Donovan

*Attorney, Agent, or Firm*—Mathews, Woodbridge & Collins

[57] ABSTRACT

A relay having a contact and terminal base assembly having a platform with mounting holes formed in corners thereof, to receive depending limbs which extend from the coil and plunger assembly so that, in this way, the two assemblies are mechanically engaged by a socket-type connection. Each assembly, then, may be separately manufactured, to support the contacts and terminals in the one assembly, and to support the coil and plunger in the other assembly, respectively; then, the two are socketed together, to form the complete relay. Such modular construction simplifies manufacturing, and facilitates final, factory adjustments, of each module-assembly, before the two are mechanically joined.

6 Claims, 2 Drawing Sheets

MODULAR, ELECTRICAL RELAY, AND A COIL AND PLUNGER ASSEMBLY AND A CONTACT AND TERMINAL BASE ASSEMBLY THEREFOR

This invention pertains to electrical relays, and in particular to I.S.O. (International Standards Organization) relays, as well as to a coil and plunger assembly, and a contact and terminal base assembly for such relays, in which the relay is of modular construction, according to the invention.

I.S.O. relays are those which conform to the criteria of the International Standards Organization for the terminal configuration thereof. As any manufacturer must meet the aforesaid criteria, most I.S.O. relays are of substantially the same construction. Consequently, such relays have complicatedly bent terminals and contacts which, are susceptible of fracturing. Too, as such relays use the frame thereof as part of the electrical circuit, a terminal has to be welded to the frame, and such is a problematical undertaking. Further, following the full assembly of the relay, it is exceedingly difficult to make final adjustments of the contacts as the same are relatively inaccessible in the completed end product.

What has long been needed is an electrical relay which will meet the I.S.O. criteria, but which is of modular construction and, therefore, avoids the aforedescribed problems and difficulties.

Similarly, then, there has been such a need for module assemblies which can be independently fabricated, given final adjustments, and then married together to form the completed I.S.O. relay.

It is an object of this invention, therefore, to set forth a modular, electrical relay, comprising a platform; contacts mounted on said platform; terminals extending from said platform; a housing; an induction coil confined within said housing; wherein said coil has a throughgoing, central void formed therein; and a plunger slidably disposed in said void; wherein said platform and said housing are only socketedly attached together in mechanical unity.

It is another object of this invention to set forth a coil and plunger assembly, for an electrical relay, comprising a frame having a substantially rectangular housing; said housing having open sides, depending limbs, a top plate and a bottom plate; wherein said plates are centrally apertured; an induction coil confined between said plates; wherein said coil has a throughgoing void formed therein; and a plunger slidably disposed in said void.

Too, it is a further object of this invention to disclose a contact and terminal base assembly, for an electrical relay, comprising a platform; contacts mounted on said platform; and terminals extending from said platform; wherein one of said contacts occupies a plurality of parallel planes.

Further objects of this invention, as well as the novel features thereof, will become more apparent by reference to the following description, taken in conjunction with the accompanying figures, in which.

Figure 1:
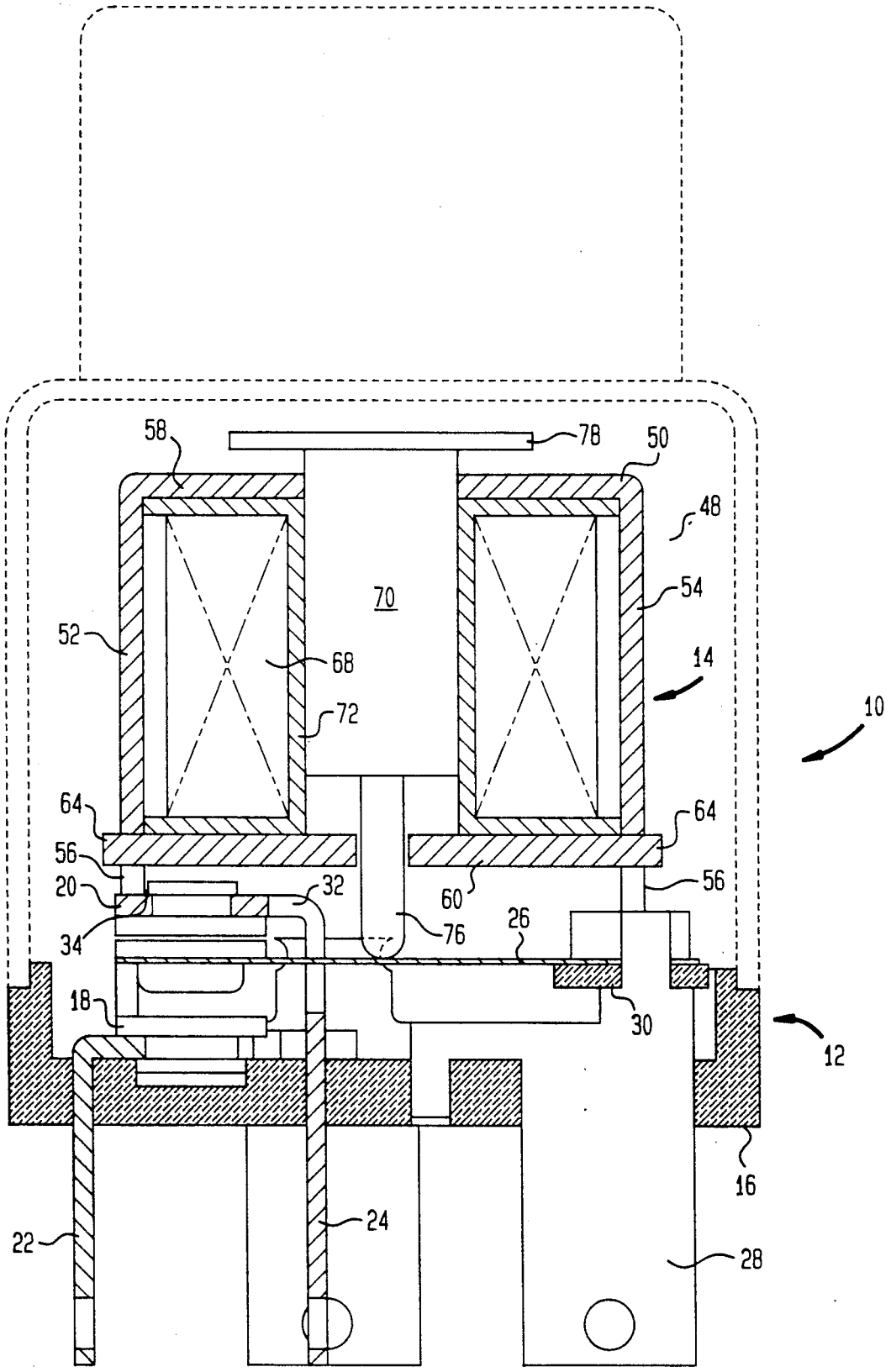
FIG. 1 is across-sectional view of the novel, modular, electrical relay, taken along a vertical centerline thereof, in an embodiment of the invention.
Figure 2:
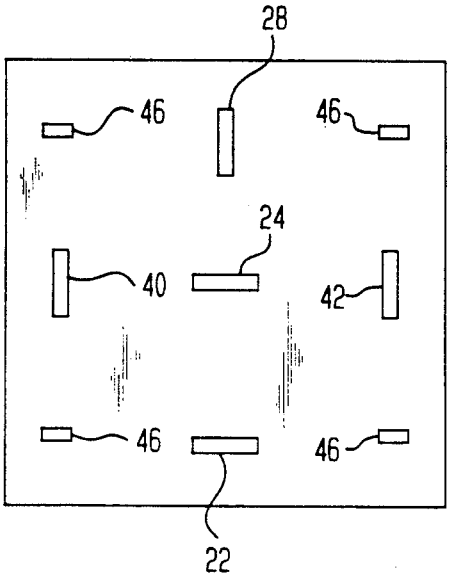
FIG. 2 is a bottom view of the novel contact and terminal base assembly of the FIG. 1 relay.
Figure 6:
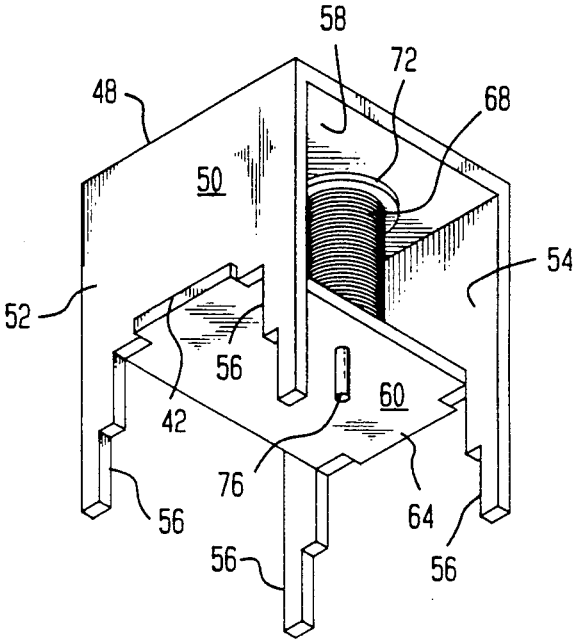
FIG. 6 is a perspective illustration of the novel coil and plunger assembly.

As shown in the figures, the inventive, modular, electrical relay 10, according to an embodiment thereof, comprises a contact and terminal base assembly 12 and a coil and plunger assembly 14. Assembly 12 comprises a platform 16 which mounts thereon a plurality of contacts, and from which a plurality of terminals extend. Contact 18 is a normally-open contact, and contact 20 is a normally-closed contact. Contact 18 is joined to terminal 22, whereas contact 20 is joined to terminal 24. A cantilevered spring 26, staked to an end of a terminal 28, has its free end thereof movably disposed between contacts 18 and 20, and normally is in engagement with contact 20. The staked end of the spring 26 is set upon a washer 30 which seats on a shoulder on a portion of terminal 28 which is exposed on the platform 16.

Terminal 20 has a bifurcation 32, and a land 34 bridging across the branches thereof, to define a framed opening 36 thereby. The free end of the spring 26 occupies the opening 36, and contact 18 is fixed on the platform 16 just below, and substantially in parallel with the land 34. Consequently, the free end of the spring 26, when relaxed, contacts the normally-closed contact 20, and when displaced, it contacts the normally-open contact 18, simply by movement between the two aforesaid contacts.

Figure 3:
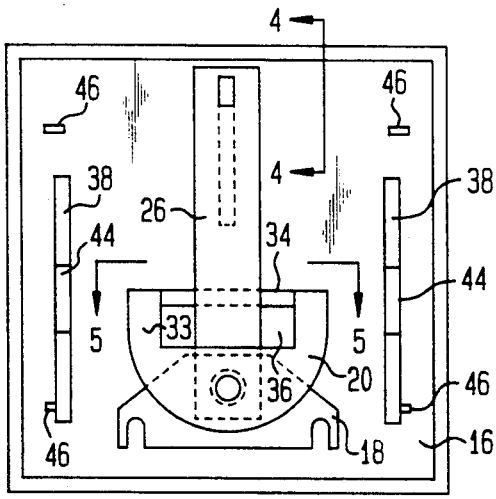
FIG. 3 is a top view of the base assembly of FIG. 2.
Figure 4:
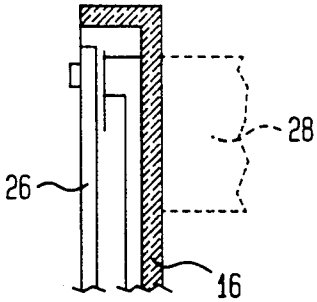
FIG. 4 is a cross-sectional view taken along section 4—4 of FIG. 3.
Figure 5:
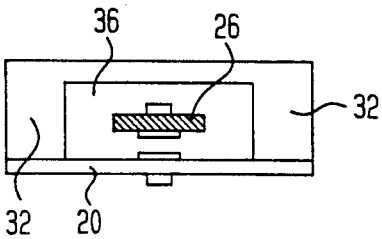
FIG. 5 is a cross-sectional view taken along section 5—5 of FIG. 3.

At opposite side of the platform 16 are arms 38; the same are platform-borne ends of terminals 40 and 42. Arms 38 and terminals 40 and 42 are isolated, electrically, from the spring 26, contacts 18 and 20, and from terminals 22, 24 and 28. The arms 38 have lugs projecting upwardly therefrom for attachment thereto of wire ends of an induction coil of the coil and plunger assembly 14. The wire-attachment lugs 44 are shown in FIG. 3, especially. To accommodate a socketed attachment of the coil and plunger assembly 14 to the platform 16, four mounting holes 46 are formed in adjacency to each of the corners of the platform 16.

The coil and plunger assembly 14 comprises a frame 48 which is embodied as a rectangular housing 50. Housing 50 is substantially a U-shaped shroud with side walls 52 and 54, and finger-type extension or depending limbs 56 projecting from the walls 52 and 54. The extension or limbs 56 socketedly enter the mounting holes 46 of the platform 16, modularly to form the whole relay.

The top of the housing 50 comprises a top plate 58, and a bottom plate 60 is secured in the side walls 52 and 54. The walls 52 and 54 have reliefs 62 formed in edges thereof, and the bottom plate 60 has tabs 64 which nestably engage the reliefs 62. Following the engagement of the tabs 64 with the reliefs 62, the same are staked in place.

Plates 58 and 60 are centrally apertured, and confine therebetween, and therewithin, an induction coil 68 and actuating plunger 70, respectively. The coil 68 is held on a bobbin 72, and of course it has a throughgoing, central void 74 formed therein to accommodate the cylindrical portion of the bobbin 72 and the translatable plunger 70. The plunger 70 has a rod 76 projecting therefrom and slidably in penetration of the aperture in plate 60 for engagement with the spring 26. Too, the plunger 70 has a head 78 at the opposite end thereof which is externally disposed relative to the housing 50.

As can readily be appreciated, with energization of the coil 68, the plunger 70 is drawn into the coil to cause the rod 76 to move the free end of the spring 26 from contact with the contact 20, and into engagement with the contact 18. When the coil is de-energized, of course, the spring 26 assumes it normal disposition in contacting engagement with the contact 20.

The novel relay 10 fully conforms to the I.S.O. criteria, is of solid, reliable construction, and yet is more easily manufactured and susceptible of final, factory adjustment. These benefits and advantages proceed from the novel modular construction thereof, in that the constituent assemblies 12 and 14 thereof can be independently fabricated and adjusted prior to the simple, socketing attachment together of the two.

While I have described my invention in connection with a specific embodiment thereof, it is to be clearly understood that this is done only by way of example, and not as a limitation to the scope of the invention, as set forth in the objects thereof, and in the appended claims.

I claim:

1. A contact and terminal base assembly, for an electrical relay, comprising:

a platform;

a movable contact cooperating with fixed contacts;

said fixed contacts mounted on said platform in a plurality of parallel planes; and terminals extending from said platform; wherein one of said contacts occupies a plurality of parallel planes wherein said one contact has a bifurcation, and a land bridging across the branches of the bifurcation to define a framed opening wherein said movable contact extends through said bifurcation.

2. A contact and terminal base assembly, according to claim 1, wherein:

one of said terminals has an elongate spring joined thereto;

an end of said spring is movably disposed within said opening.

3. A contact and terminal base assembly, according to claim 1, wherein:

one of said contacts is set on said platform substantially in parallel with said land.

4. A contact and terminal base assembly, according to claim 1, wherein:

a pair of said terminals have arms set on said platform; and said arms have lugs projecting therefrom.

5. A contact and terminal base assembly, according to claim 4, wherein:

said terminals and arms of said pair are isolated, electrically, from said contacts and other terminals extending from said platform.

6. A contact and terminal base assembly, according to claim 1, wherein:

said platform has a plurality of mounting holes formed therein for receiving therein limbs of a coil and plunger assembly.

* * * * *